US006153842A

United States Patent [19]

Sato

[11] Patent Number: 6,153,842

[45] Date of Patent: Nov. 28, 2000

[54] LEVER SWITCH

[75] Inventor: Naoki Sato, Aichi, Japan

[73] Assignee: Kabushiki Kaisha Tokai Rika Denki Seisakusho, Aichi, Japan

[21] Appl. No.: 09/469,968

[22] Filed: Dec. 21, 1999

[30] Foreign Application Priority Data

Jan. 13, 1999 [JP] Japan ..... 11-006514

[51] Int. Cl.[7] ..... H01N 9/00

[52] U.S. Cl. ..... 200/335; 200/61.27; 200/61.54

[58] Field of Search ..... 200/4, 17 R, 61.27, 200/61.3–61.36, 61.54, 332, 335

[56] References Cited

U.S. PATENT DOCUMENTS 4,328,431 5/1982 Usami ..... 307/10 R
4,414,442 11/1983 Berginski et al. ..... 200/21.27
5,182,422 1/1993 Botz et al. ..... 200/61.54
5,200,584 4/1993 Nagaya ..... 200/4
5,600,110 2/1997 Neubauer ..... 200/61.54

*Primary Examiner*—Michael Friedhofer
*Attorney, Agent, or Firm*—Crompton, Seager & Tufte, LLC

[57] ABSTRACT

A lever switch that prevents a lever from being dislocated. The lever is shifted between an upper position and a lower position. The lower surface of an upper wall of the holder is a first main stopper. A pair of notches formed on the sides of the holder and a pair of projections formed to correspond to the notches on the lever form a first auxiliary stopper. The first main stopper and the first auxiliary stopper limit the downward rotation of the lever. A projection formed on the upper surface of the lower wall of the holder is a second main stopper. A recess formed in the lower surface of the upper wall of the holder and a projection formed on the lever to correspond to the recess form a second auxiliary stopper. The second main stopper and the second auxiliary stopper limit the downward rotation of the lever.

13 Claims, 6 Drawing Sheets

LEVER SWITCH

BACKGROUND OF THE INVENTION

The present invention relates to a lever switch.

Vehicles typically have lever switches for operating wipers and the like. As shown in FIGS. 6 and 7, a prior art lever switch includes a contact holder 21 and a lever 24. The contact holder 21 includes a connector 22 and a holder 23. Four connection holes 22*a* are formed on the upper surface of the connector 22. Connection terminals extending from an external circuit (not shown) are respectively connected to the connection holes 22*a* to connect the lever switch to the external circuit.

The holder 23 is integrally formed with the connector 22. The holder 23 rotatably supports the lever 24. U-shaped slits 23*a* are respectively formed in the opposed side walls of the holder 23. The slits 23*a* respectively tabs 23*b* on the side walls of the holder 23. The tabs 23*b* include support holes 23*c*, which are through holes. The lever 24 is received by the tabs 23*b*. As shown in FIG. 7A, part of the upper wall of the holder 23 forms an upper stopper 23*d*. A lower stopper 23*e* is formed on the lower wall of the holder 23.

The lever 24 includes an actuator 25 and an arm 26. The arm 26 is integrally formed with the actuator 25. The rectangular actuator 25 is located in the holder 23. A space is formed between the outer surface of the actuator 25 and the inner surface of the holder 23. Rotational pivot joint shafts 25*a* respectively extend from the side walls of the actuator 25. The shafts 25*a* are supported by the corresponding support holes 23*c*.

Accordingly, when the arm 26 is moved downward as shown by the arrow in FIG. 7A, the distal end of the actuator 25 moves upward in the holder 23. When the arm 26 is moved upward as shown in FIG. 7B, the distal end of the actuator 25 moves downward in the holder 23.

However, when the arm 26 is moved downward as shown in FIG. 7A, the distal upper surface of the actuator 25 contacts the upper stopper 23*d*. If the arm 26 is forced further downward from this position, a force F from the inner surfaces of the support holes 23*c* is applied to the shafts 25*a*. The upper stopper 23*d* serves as a fulcrum. The force F may dislocate the shafts 25*a* from the support holes 23*c*.

When the arm 26 is moved upward as shown in FIG. 7B, the lower surface of the actuator 25 contacts the lower stopper 23*e*. If the arm 26 is forced further upward, a force F, the fulcrum of which is the lower stopper 23*e*, is applied from the inner surfaces of the support holes 23*c* to the shafts 25*a*. The force F may dislocate the shafts 25*a* from the support holes 23*c*. Therefore, it is required to prevent the shafts 25*a* from being dislocated from the support holes 23*c* during the movement of the arm 26.

SUMMARY OF THE INVENTION

An objective of the present invention is to provide a lever switch having a lever that is not easily dislocated from the contact holder.

To achieve the above objective, the present invention provides a lever switch structured as follows. The lever switch includes a holder and a lever. The lever is pivotally supported by the holder through a pivot joint. A main stopper is formed in the holder to limit the rotation of the lever to a certain position with respect to the holder. An auxiliary stopper limits the rotation of the lever to a certain position with respect to the holder in cooperation with the main stopper. The auxiliary stopper is located on the opposite side of the pivot joint from the main stopper.

The present invention also provides a lever switch structured as follows. The lever switch includes a lever and a holder. The lever includes an arm and an actuator. The holder holds the actuator. A pivot joint supports the lever to rotate with respect to the holder. A main stopper limits the rotation of the lever in a predetermined direction to a predetermined position. An auxiliary stopper is located on the opposite side of the pivot joint from the main stopper. The auxiliary stopper limits the rotation of the lever in the predetermined direction to the predetermined position in cooperation with the main stopper.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A lever switch according to one embodiment of the present invention will now be described with reference to FIGS. 1–5.

Figure 1:
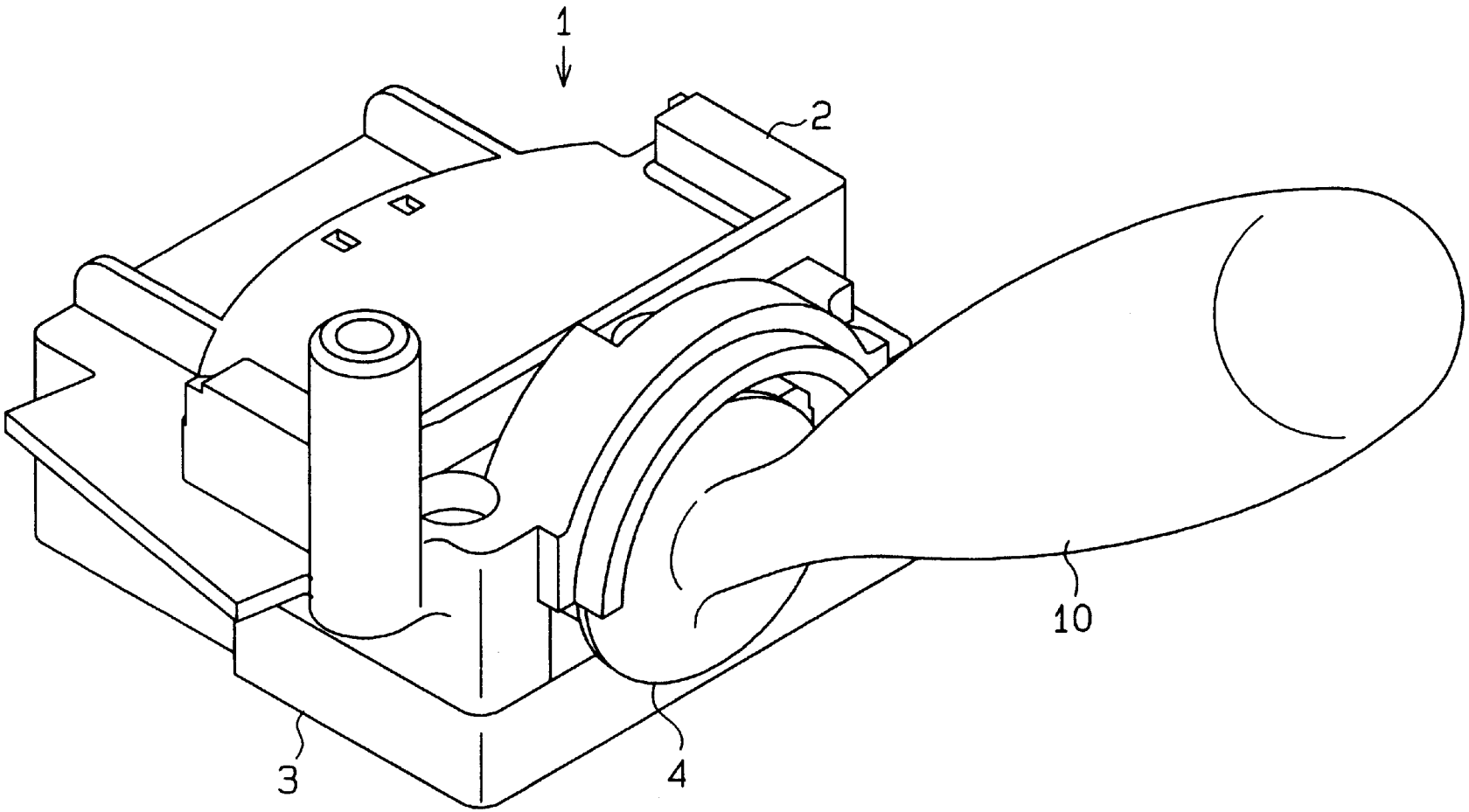
FIG. 1 is a perspective view of a lever switch according to one embodiment of the present invention.
Figure 2A:
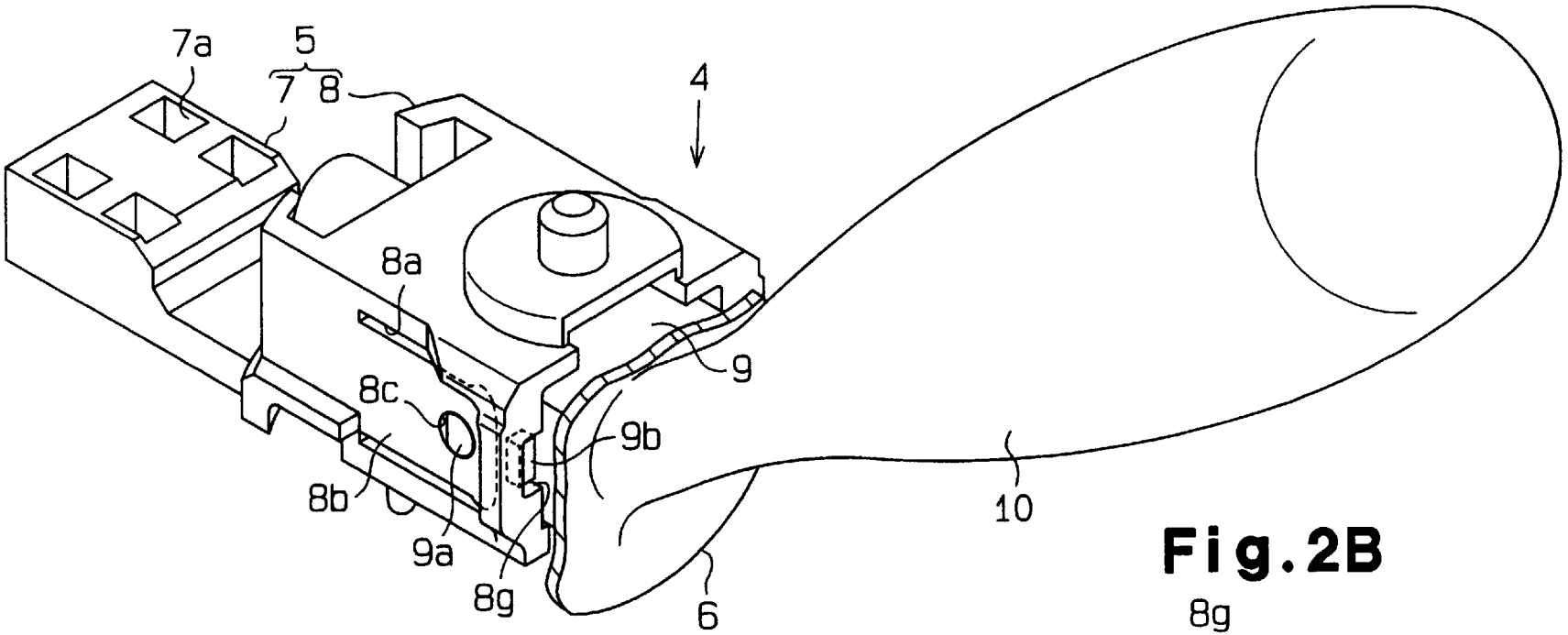
FIG. 2A is a perspective view of a contact holder and a lever of the lever switch of FIG. 1.

As shown in FIG. 1, the lever switch 1 includes a switch body 4, a case 2, and an insulator 3. The case 2 and the insulator 3 support the switch body 4. As shown in FIG. 2A, the switch body 4 includes a contact holder 5 and a lever 6. The contact holder 5 includes a connector 7 and a holder 8. Four connection holes 7*a* are formed in the upper surface of the connector 7. Connection terminals that extend from an external circuit (not shown) are respectively connected to the connection holes 7*a* to connect the lever switch 1 to the external circuit.

The holder 8 rotatably supports the lever 6. The holder 8 is integrally formed with the connector 7. U-shaped slits 8*a* are respectively formed in the opposed sides of the holder 8. Each slit 8*a* forms a tab 8*b*. Each tab 8*b* has a pivot hole 8*c*. The tabs 8*b* support the lever 6.

The lever 6 includes an actuator 9 and an arm 10. The arm 10 is integrally formed with the actuator 9. A couple of pivot joint shafts 9*a* respectively project from the sides of the actuator 9. The shafts 9*a* are rotatably supported by the corresponding pivot holes 8*c*.

Figure 3:
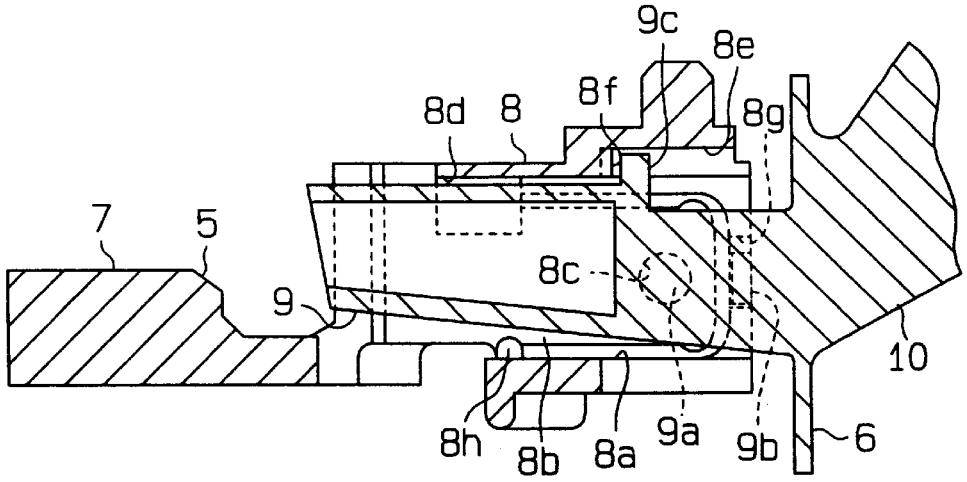
FIG. 3 is a cross sectional view showing the contact holder and the lever at a neutral position.

As shown in FIG. 3, a first main stopper 8*d* is formed on the lower surface of the upper wall of the holder 8. A recess 8*e* is formed near the entrance of the holder 8 (rightward of the first main stopper 8*d* in FIG. 3). The recess 8*e* is located above the pivot holes 8*c*. The first main stopper 8*d* is located on the opposite side (leftward in FIG. 3) of the pivot holes 8*c* from the arm 10.

As shown in FIG. 2A, opposed notches 8*g* are formed in the entrance rim (right end in FIG. 3) of the holder 8. The notches 8*g* are located on the opposite side (rightward in FIG. 3) of the pivot holes 8*c* from the first main stopper 8*d*.

A lower projection 8*h*, which is a second main stopper, extends upward from the lower wall of the holder 8. The lower projection 8*h* is located below the pivot holes 8*c* in FIG. 3. As shown in FIG. 5B, a contact surface 8*f* is located near the center of the holder 8 in the longitudinal direction. The contact surface 8*f* extends from the left end surface of the recess 8*e* toward the entrance (rightward in FIG. 5B).

Figure 2B:
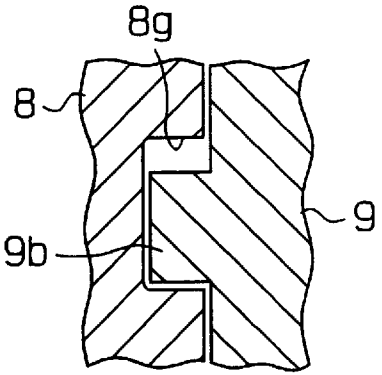
FIG. 2B is an enlarged partial cross sectional view showing an auxiliary stopper at its neutral position.

As shown in FIG. 2A, a pair of horizontal projections 9*b* are respectively formed on the sides of the actuator 9. The projections 9*b* extend horizontally and parallel to the shafts 9*a*. As shown in FIG. 2B, the projections 9*b* are located in the corresponding notches 8*g* and can move in the notches 8*g*. The projections 9*b* and the notches 8*g* form a first auxiliary stopper.

Further, a vertical, or upper, projection 9*c* extends upward from the actuator 9 and is located in the recess 8*e*. The contact surface 8*f* and the upper projection 9*c* form a second auxiliary stopper.

The actuator 9 is pivoted about the shafts 9*a* when a force is manually applied to the arm 10. That is, the lever switch 1 is shifted between three positions, which include a neutral position shown in FIG. 3, a lower position shown in FIG. 4A, and an upper position shown in FIG. 5A.

Figure 4A:
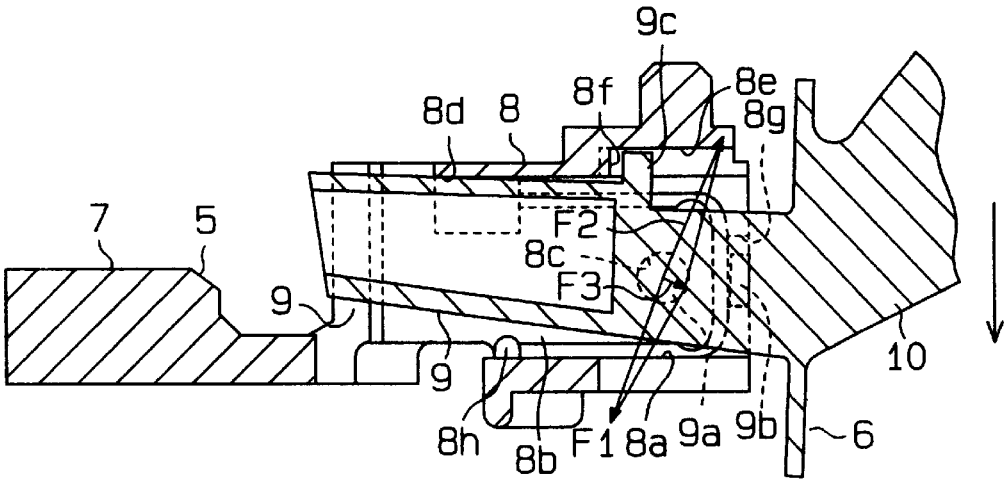
FIG. 4A is a cross sectional view showing the contact holder and the lever at a lower position.
Figure 4B:
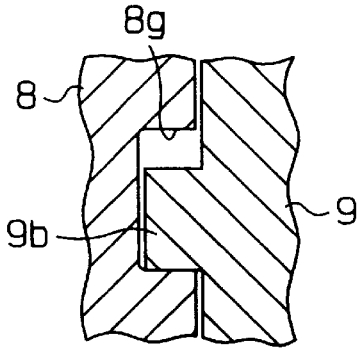
FIG. 4B is a cross sectional view showing the auxiliary stopper at the lower position.

As shown in FIG. 4A, when the lever switch 1 is shifted to the lower position by the arm 10, the actuator 9 pivots about the shafts 9*a* and the left end of the actuator 9 moves upward in the holder 8. Then, the upper surface of the actuator 9 contacts the first main stopper 8*d*. At this time, the lower ends of the projections 9*b* contact the lower surfaces of the notches 8*g* as shown in FIG. 4B.

Figure 5A:
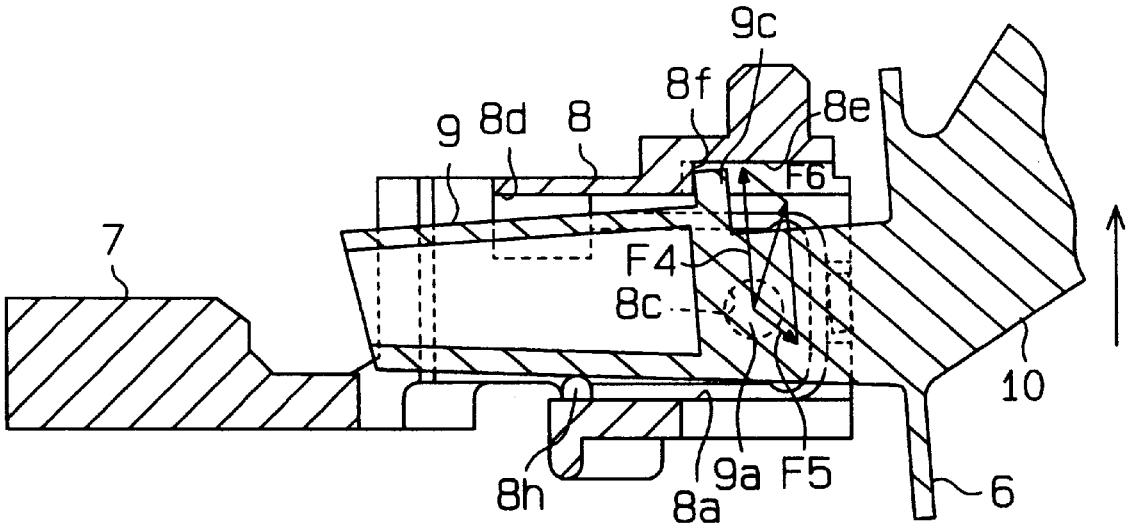
FIG. 5A is a cross sectional view showing the contact holder and the lever at an upper position.
Figure 5B:
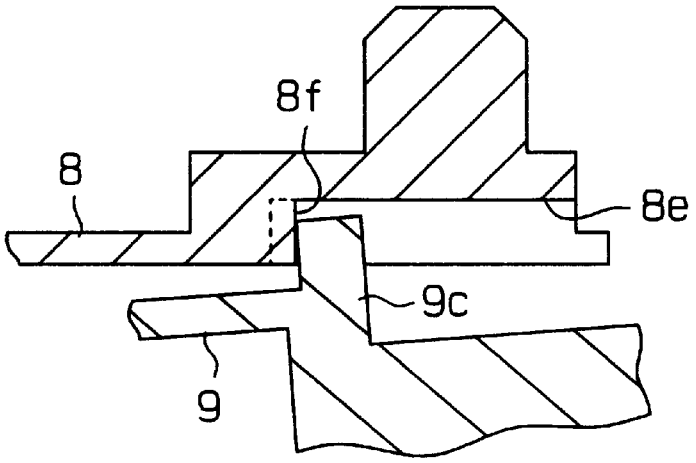
FIG. 5B is an enlarged partial cross sectional view showing the auxiliary stopper at its upper position.
Figure 6:
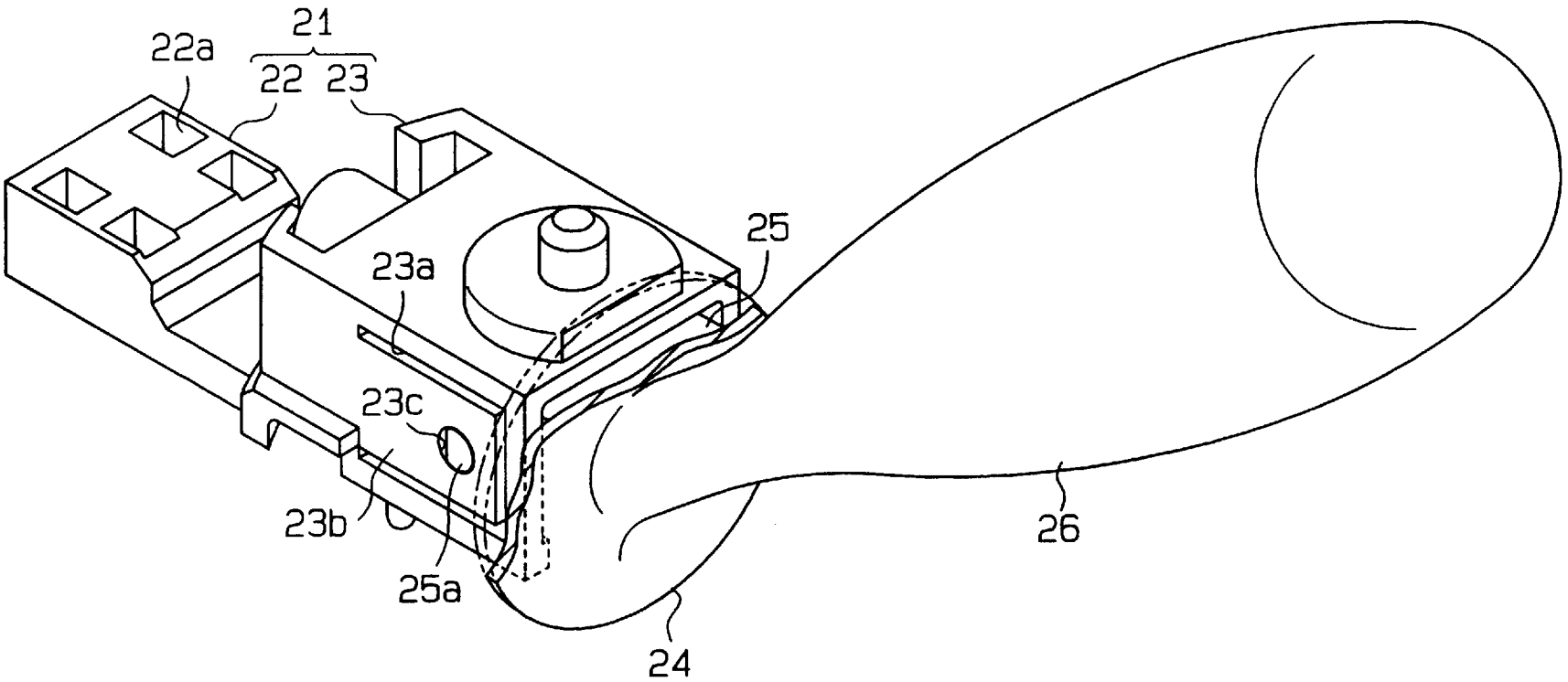
Fig.6 (Prior Art)
FIG. 6 is a perspective view showing a prior art lever switch.
Figure 7A:
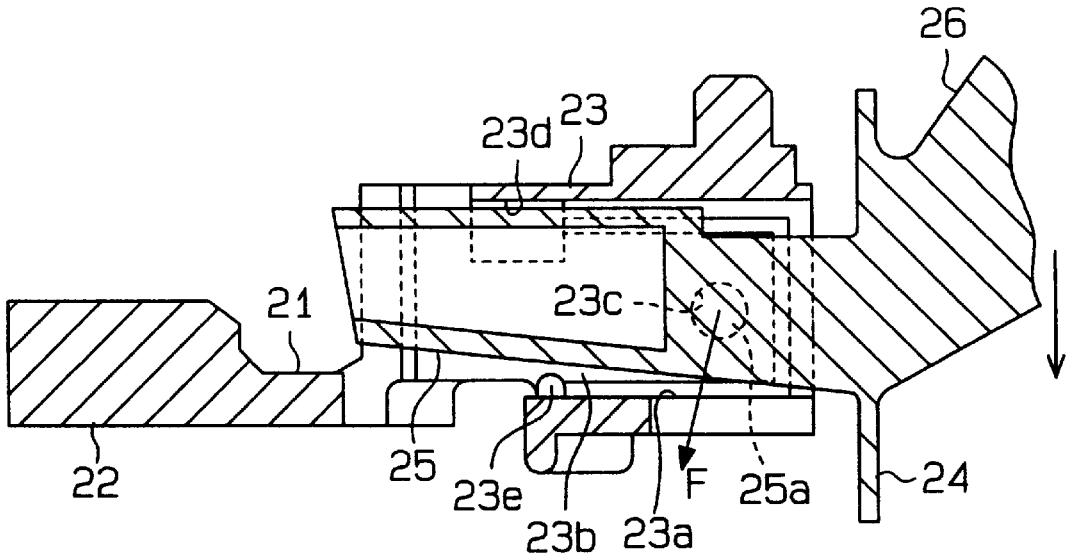
Fig.7A(Prior Art)
FIG. 7A is a cross sectional view showing a contact holder and a lever of the lever switch of FIG. 6 at a lower position.
Figure 7B:
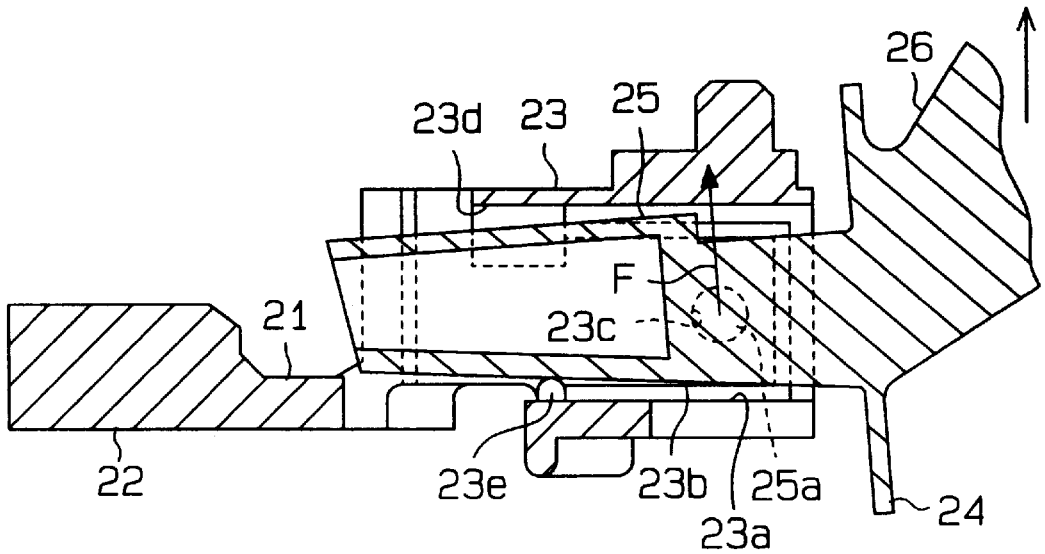
Fig.7B(Prior Art)
FIG. 7B is a cross sectional view showing the contact holder and the lever of the lever switch of FIG. 6 at an upper position.

As shown in FIG. 5A, when the lever switch is shifted to the upper position by the arm 10, the actuator 9 pivots about the shafts 9*a* and the left end of the actuator 9 moves downward in the holder 8. Then, the lower surface of the actuator 9 contacts the lower projection 8*h*. At this time, the upper projection 9*c* contacts the contact surface 8*f* as shown in FIG. 5B.

At the lower position shown in FIG. 4A, the upper surface of the actuator 9 contacts the first main stopper 8*d* and the projections 9*b* contact the lower surfaces of the notches 8*g*, which prevents further downward movement of the arm 10. When the arm 10 is forced further downward, downward forces F1 are applied to the shafts 9*a* from the inner surfaces of the pivot holes 8*c* as shown in FIG. 4A. The first main stopper 8*d* serves as a fulcrum for the forces F1. Further, upward forces F2 are applied to the shafts 9*a* from the inner surfaces of the pivot holes 8*c*. The lower surfaces of the notches 8*g* serve as fulcrums for the forces F2. F3 represents resultant forces of the downward forces F1 and the upward forces F2. The resultant forces F3 are smaller than the downward forces F1.

At the upper position shown in FIG. 5A, the lower surface of the actuator 9 contacts the lower projection 8*h* and the upper projection 9*c* contacts the contact surface 8*f*, which prevents further upward movement of the arm 10. When the arm 10 is forced further upward, upward forces F4 are applied to the shafts 9*a* from the inner surfaces of the pivot holes 8*c*. The lower projection 8*h* serves as a fulcrum for the upward forces F4. Further, forces F5 are applied to the shafts 9*a* from the inner surfaces of the pivot holes 8*c*. The contact surface 8*f* serves as a fulcrum for the forces F5. F6 represents resultant forces of the upward forces F4 and the forces F5. Since the forces F5 have components that are opposite to the upward forces F4, the resultant forces F6 are smaller than the upward forces F4.

The illustrated embodiment has the following advantages.

(1) When the arm 10 is lowered and the upper surface of the actuator contacts the first main stopper 8*d*, the projections 9*b* contact the lower surfaces of the corresponding notches 8*g*. If the arm 10 is forced further downward, the downward forces F1 and the upward forces F2 are applied to the shafts 9*a*. The downward forces F1 substantially balance the upward forces F2, and the resultant forces F3 are small. Accordingly, the resultant forces F3 applied to the shafts 9*a* are smaller than the forces F applied to the shafts 25*a* of the prior art. As a result, the shafts 9*a* are not easily dislocated from the pivot holes 8*c* when the arm 10 is moved in the downward direction.

(2) When the arm 10 is raised and the lower surface of the actuator 9 contacts the second stopper, an end of the upper projection 9*c* on the upper surface of the actuator 9 contacts the contact surface 8*f*. If the arm 10 is forced further upward, the upward forces F4 and the forces F5 are applied to the shafts 9*a*. Since the forces F5 have force components that are opposite to the upward forces F4, the resultant forces F6 are smaller than the upward forces F4. Accordingly, the resultant forces F6 applied to the shafts 9*a* are smaller than the upward forces F applied to the shafts 25*a* of the prior art. As a result, the shafts 9*a* are not easily dislocated from the pivot holes 8*c* when the arm 10 is moved in the upward direction.

The illustrated embodiment may further be varied as follows.

Instead of the shafts 9*a*, recesses may be formed in the actuator 9. In this case, projections are formed on the tabs 8*b* instead of the pivot holes 8*c*. Such projections would be rotatably supported by the recesses in the actuator 9. In this case, the advantages are the same as those in the first embodiment.

Instead of the projections 9*b*, recesses may be formed. In this case, projections are formed on the holder 8 instead of the notches 8*g*. When the arm 10 is lowered and the upper surface of the actuator 9 contacts the first main stopper 8*d*, the upper ends of such projections would contact the upper surfaces of the recesses of the actuator 9. In this case, the advantages are the same as those of the first embodiment.

The upper projection 9*c* may be omitted. In this case, the notches 8*g* are preferably formed such that the upper walls of the notches 8*g* contact the upper surfaces of the projections 9*b* when the lever switch 1 is at the upper position. In this case, the projections 9*b* and the notches 8*g* serve as the first and second auxiliary stoppers.

One of the projections 9*b* and the corresponding notch 8*g* may be omitted.

Either the projections 9*b* or the upper projection 9*c* may be omitted. In this case, the lever 6 is not easily dislocated from the holder 5 compared to the prior art switches.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A lever switch comprising:

a holder;

a lever, which is pivotally supported by the holder through a pivot joint;

a main stopper, which is formed in the holder to limit the rotation of the lever to a certain position with respect to the holder; and an auxiliary stopper, which limits the rotation of the lever to the certain position with respect to the holder in cooperation with the main stopper, wherein the auxiliary stopper is located on the holder on an opposite side of the pivot joint from the main stopper.

2. The lever switch according to claim 1, wherein the auxiliary stopper includes a notch formed in the holder and a projection formed in the lever to correspond to the notch.

3. A lever switch comprising:

a lever, which includes an arm and an actuator;

a holder, which holds the actuator;

a pivot joint for supporting the lever to rotate with respect to the holder;

a main stopper, which is formed in the holder, which limits the rotation of the lever in a predetermined direction to a predetermined position; and an auxiliary stopper, which is located on the holder on an opposite side of the pivot joint from the main stopper, wherein the auxiliary stopper limits the rotation of the lever in the predetermined direction to the predetermined position in cooperation with the main stopper.

4. The lever switch according to claim 3, wherein the main stopper is formed in the holder and the actuator contacts the main stopper when the lever is at the first position.

5. The lever switch according to claim 4, wherein the auxiliary stopper includes a projection formed in the lever and a notch formed in the holder, wherein the notch corresponds to the projection, and the projection and the notch are located closer to the arm than to the pivot joint.

6. The lever switch according to claim 3, wherein the main stopper is a first main stopper, the auxiliary stopper is a first auxiliary stopper, the predetermined direction is a first direction, and the predetermined position is a first position, the lever switch further including:

a second main stopper, which is formed in the holder, which limits the rotation of the lever in a second direction, which is opposite to the first direction, to a second position; and a second auxiliary stopper, which is located on the holder on an opposite side of the pivot joint from the second main stopper, wherein the second auxiliary stopper limits the rotation of the lever in the second direction to the second position in cooperation with the second main stopper.

7. The lever switch according to claim 3, wherein the lever extends in a generally longitudinal direction, having a first end and a second end, wherein the actuator is located proximate the first end of the lever, the arm being located proximate the second end of the lever, wherein the pivot joint is located between the arm and the actuator.

8. A lever switch comprising:

a holder; and a lever having a first end and a second end, and an extent of rotation with respect to a holder, which is pivotally supported by the holder through a pivot joint, wherein the lever is permitted to rotate between a first position and a second position, the lever including:

an arm located proximate the first end of the lever, and having a position relative to the holder; and an actuator, which is located proximate the second end of the lever, wherein the actuator is moved in accordance with the position of the arm;

a first main stopper and a first auxiliary stopper, which limit the extent of rotation of the lever in a first direction to the first position, wherein the first auxiliary stopper is located on the holder on an opposite side of the pivot joint from the first main stopper; and a second main stopper and a second auxiliary stopper, which limit the extent of rotation of the lever in a second direction to the second position, wherein the second auxiliary stopper is located on the holder on an opposite side of the pivot joint from the second main stopper.

9. The lever switch according to claim 8, wherein the first main stopper is located on an inner wall surface of the holder that is opposite to an upper surface of the actuator.

10. The lever switch according to claim 9, wherein the first auxiliary stopper includes at least one notch, which is formed in at least one of a pair of opposed side walls of the holder, and a horizontal projection formed in a side wall of the actuator to correspond to the notch, wherein the horizontal projection contacts an edge surface of the notch when the lever is at the first position.

11. The lever switch according to claim 8, wherein the second main stopper is located on an inner wall surface of the holder that is opposite to a lower surface of the actuator.

12. The lever switch according to claim 11, wherein the second auxiliary stopper includes a vertical projection, which extends upward from the actuator, and a recess, which is formed in the holder to correspond to the vertical projection, wherein the vertical projection contacts a surface of the recess when the lever is located at the second position.

13. A lever switch comprising:

a holder, which includes a tubular portion having an upper wall, a lower wall, and a pair of side walls;

a lever, which is rotatably supported by the holder through a pivot joint defining an axis of rotation, the lever being pivotal between a predetermined upper position and lower position, the lever including:

an arm; and an actuator, which extends from the arm and is located on the holder on an opposite side of the pivot joint from the arm, wherein the actuator is accommodated in the tubular portion and includes an upper surface, a lower surface, and a pair of side surfaces, which respectively correspond to the upper wall, the lower wall, and the pair of side walls;

a first main stopper and a first auxiliary stopper, which limit the extent of rotation of the lever in a first direction to the lower position, wherein the first main stopper is located on the upper wall of the tubular portion, wherein the first auxiliary stopper includes a notch, which is formed on at least one of the pair of side walls of the holder, and a horizontal projection, which is formed on one of the side surfaces of the actuator to correspond to the notch and which extends generally parallel to [in the direction of] the axis of rotation of the pivot joint, wherein the horizontal projection contacts an edge surface of the notch when the lever is at the lower position; and a second main stopper and a second auxiliary stopper, which limit the extent of rotation of the lever in a second direction to the upper position, wherein the second main stopper is located on the lower wall of the tubular portion, wherein the second auxiliary stopper includes a recess, which is formed in the upper wall of the holder, and a vertical projection, which extends from the upper surface of the actuator, wherein the vertical projection contacts the end surface of the recess when the lever is in the upper position.

* * * * *

UNITED STATES PATENT AND TRADEMARK OFFICE

CERTIFICATE OF CORRECTION

PATENT NO : 6,153,842

DATED : November 28, 2000

INVENTOR(S) : Naoki Sato

It is certified that error appears in the above-identified patent and that said Letters Patent is hereby corrected as shown below:

In column 7, line 10, please delete "[in the direction of]".

Signed and Sealed this

Eighth Day of May, 2001

*Attest:*

Nicholas P. Godici

NICHOLAS P. GODICI

*Attesting Officer*

*Acting Director of the United States Patent and Trademark Office*